United States Patent [19]

Scribner

[11] 4,175,688

[45] Nov. 27, 1979

[54] SEMI-AUTOMATIC STOCK FEEDER

[76] Inventor: Albert W. Scribner, 6 Country Club Rd., Darien, Conn. 06820

[21] Appl. No.: 871,490

[22] Filed: Jan. 23, 1978

[51] Int. Cl.[2] ..... B65H 17/36

[52] U.S. Cl. ..... 226/158; 83/277

[58] Field of Search ..... 226/144, 146, 149, 150, 226/162, 158, 166; 83/277

[56] References Cited

U.S. PATENT DOCUMENTS

| | | | |
|---|---|---|---|
| 3,038,645 | 6/1962 | Nordlof | 226/149 |
| 3,329,327 | 7/1967 | Scribner | 226/150 |

*Primary Examiner*—Robert J. Spar
*Assistant Examiner*—H. Grant Skaggs

[57] ABSTRACT

A pneumatic stock feeder for intermittently advancing strip stock into the work station of a punch press having a reciprocating working ram; the feeder having a control plunger that is adapted to be operated by the press ram. The feeder has an improved and simplified semi-automatic fluid valving arrangement that is adapted to be controlled by the movement of said control plunger whereby the feed slide means of the feeder is normally positioned in an index position, i.e. in a position ready to feed stock, and upon being triggered by a pressure start pulse is actuated through first a feed stroke and then automatically returned through an index stroke back to its normal position where it will remain until the initiation of the next cycle triggering pressure start pulse. The control plunger is movable from a first or normal position to a second or depressed position and then returned to its first position in response to the downward and upward movements respectively of the punch press ram; the feed index cycle being initiated in response to the movement of the control plunger from its depressed position back to its first position.

16 Claims, 15 Drawing Figures

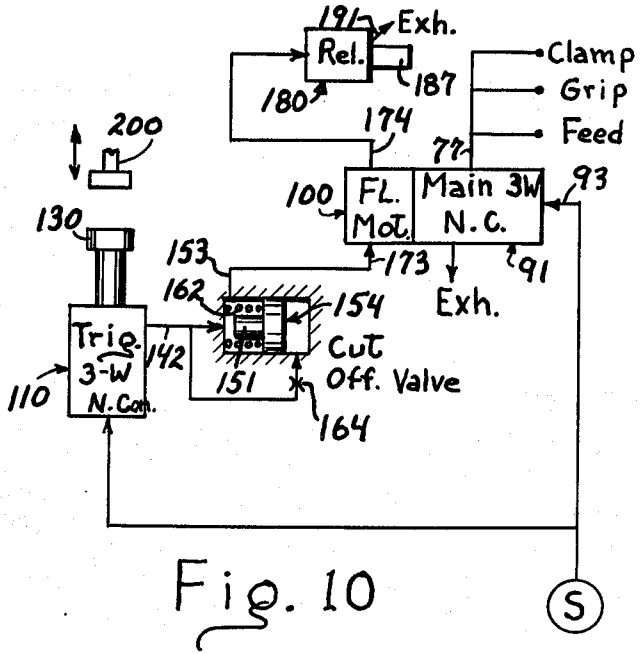
Fig. 10
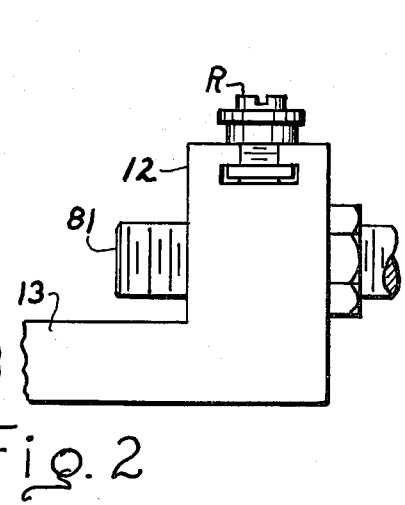
Fig. 2
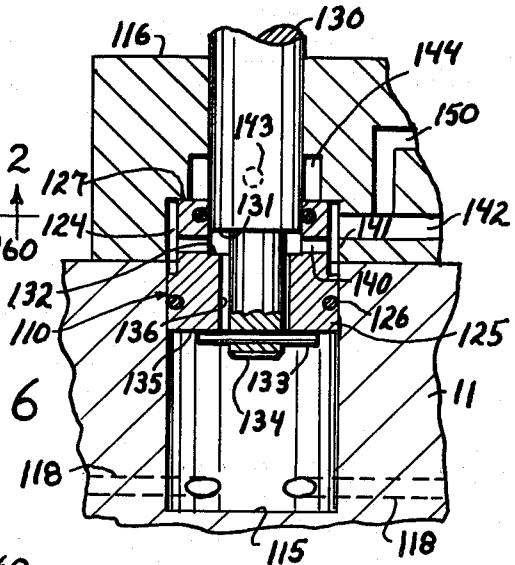
Fig. 6
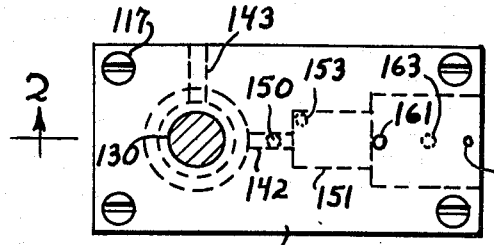
Fig. 5
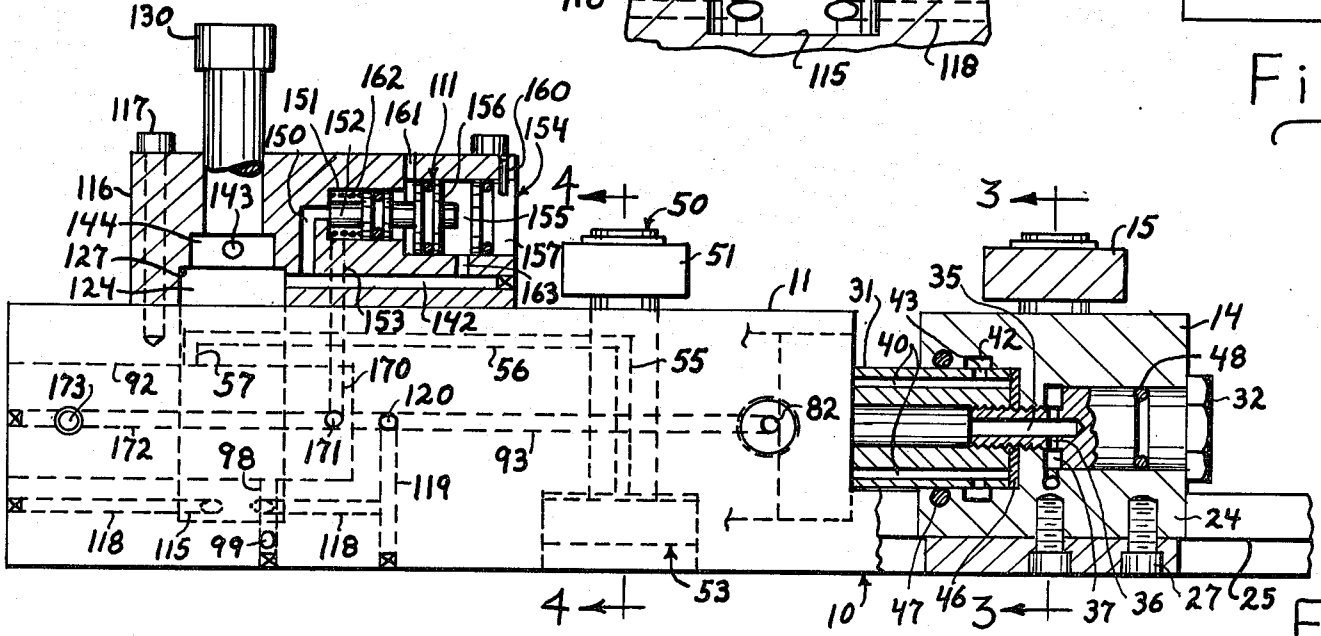

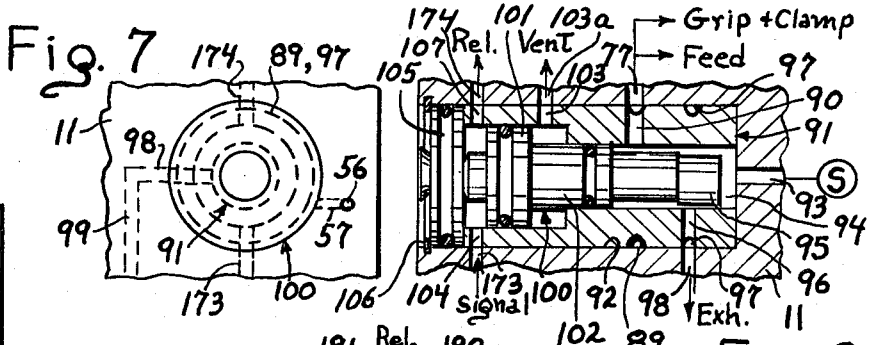
Fig. 7
Fig. 8
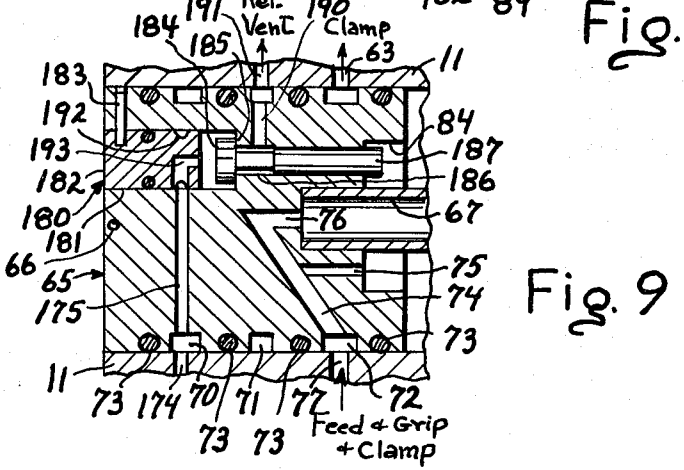
Fig. 9
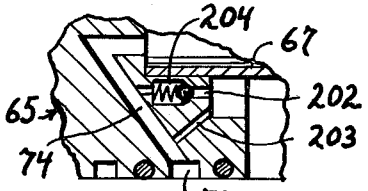
Fig. 11
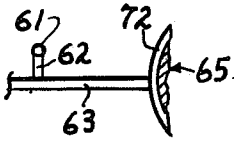
Fig. 15
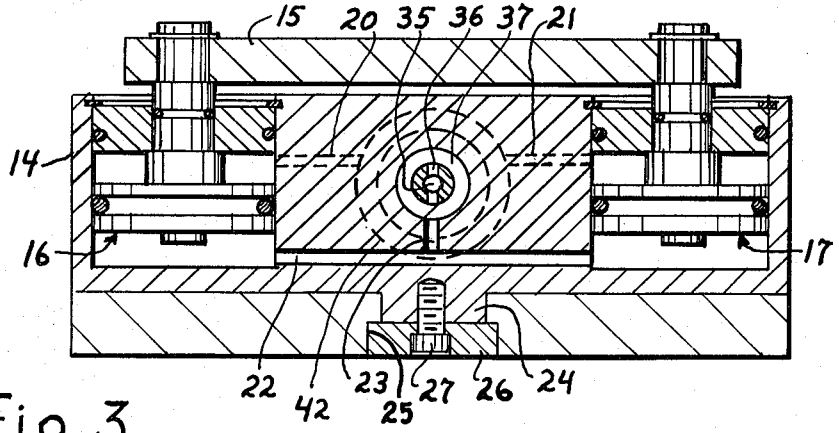
Fig. 3
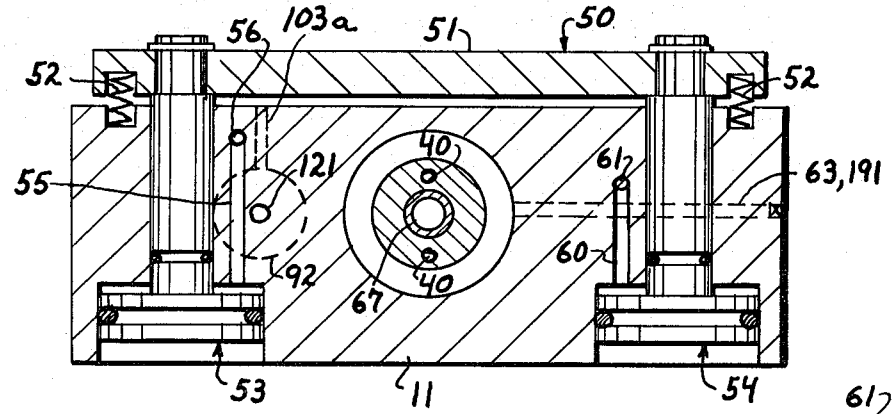
Fig. 4

SEMI-AUTOMATIC STOCK FEEDER

BACKGROUND OF THE INVENTION

Conventional pneumatic punch press feeders such as those illustrated in U.S. Pat. No. 3,038,645 and 3,329,327 are arranged so as to be operated in response to the reciprocating movement of the ram of the punch press. Here an indexing or non feed stroke of the feeder is initiated in response to the downward motion of the ram while a feed stroke thereof is initiated in response to the upward motion of the ram; there normally being nearly equal press cycle time for each of said strokes. These pneumatic feeders have been successfully sold and used for some time, however they often exhibit disadvantageous operational characteristics such as being noisy, generating a significant hammering action of the feed slide, and having a set up requirement involving two press-feeder interfacing control points during the said downward and upward motions of said press ram. Most of these disadvantages can be eliminated or at least minimized by using a semi-automatic control whereby the feed slide is normally positioned in an indexed position and the feeder, when triggered during the upward movement of said press ram, is cycled first through a feed stroke and then automatically through a nonfeed or index stroke so as to return to and remain in said initial indexed position until the feed index cycle is again triggered by the next cycle of operation of the press. Semi-automatic control systems have been previously proposed however such have had the feeder controlling the operation of the press (rather than vice versa) or, where the press is arranged to control the feeder a press crank shaft to feeder interface arrangement is used. This latter type arrangement involves a relatively cumbersome mechanical system of rotary cams, switches and/or valves which in turn is not only expensive but also requires an excessive amount of time in order to properly interface the feeder with the press.

SUMMARY OF THE INVENTION

The present invention relates to an improved control system for a pneumatically operated punch press feeder. More particularly the invention relates to a greatly simplified low cost fluid circuit and control arrangement for semi-automatically controlling the fluid motors of a pneumatic punch press feeder; which control circuit and arrangement requires only a very simple, direct and easy set up procedure for quickly interfacing the feeder with the press. The feeder control circuit is provided with a main control means which controls the various fluid motors of the feeder and which is adapted to be controlled on the one hand by the combined action of a ram actuated trigger valve and a self cut off valve in order to produce a feed stroke of the feeder, and on the other hand to be subsequently controlled by a release valve means that is automatically operated in response to the terminal portion of the feed stroke of said feed slide so as to initiate an index stroke of said feed slide. A control plunger means is provided for initiating the feed index cycle of operation of said feeder, which plunger means is movable from a first or normal position to a second or depressed position and back in response to the downward and upward movement respectively of the press ram; the feed index cycle being initiated during the return movement of said plunger means back to its said first or normal position.

With such a plunger control arrangement no special equipment is needed to interface the press and the feeder and the feeder may thus be quickly and easily set up for operation on and with the press.

The primary object of the invention is to provide a compact inexpensive semi-automatic control system for a pneumatic punch press feeder which may be quickly and easily interfaced with the press.

Another object of the invention is to provide a semi-automatic punch press feeder having a control plunger that is adapted to be operated by ram of the punch press.

A further object of the invention is to provide a semi-automatic punch press feeder having a control circuit that includes a self cut off valve means.

Other objects of the invention will become apparent as the disclosure progresses.

In the drawings:

FIG. 2 is a front elevational view of the apparatus illustrated in FIG. 1.

FIG. 3 is a cross sectional view taken along section line 3—3 of FIG. 2.

FIG. 4 is a cross sectional view taken along section line 4—4 of FIG. 2.

FIG. 5 is a plan view of the valve block.

FIG. 6 is an axial sectional view in vertical elevation of the trigger valve assembly.

FIG. 7 is a general left side view of the apparatus shown in FIG. 8.

FIG. 8 is a plan view taken in a horizontal axial sectional plane and shows the general construction and operation of the main three way control valve.

FIG. 9 is an elevational axial sectional view of the plug means for the main cylinder of the present feeder.

FIG. 10 is a circuit diagram for the pneumatic controls of the present feeder.

FIG. 11 is a fragmentary elevational view similar to FIG. 9 showing a modification of the main cylinder plug means.

FIG. 15 is a diagrammatic view illustrating a line connection to the plug means for the main fluid motor of the feeder shown in FIGS. 1 and 2.

DETAILED DESCRIPTION OF THE INVENTION

Figure 1:
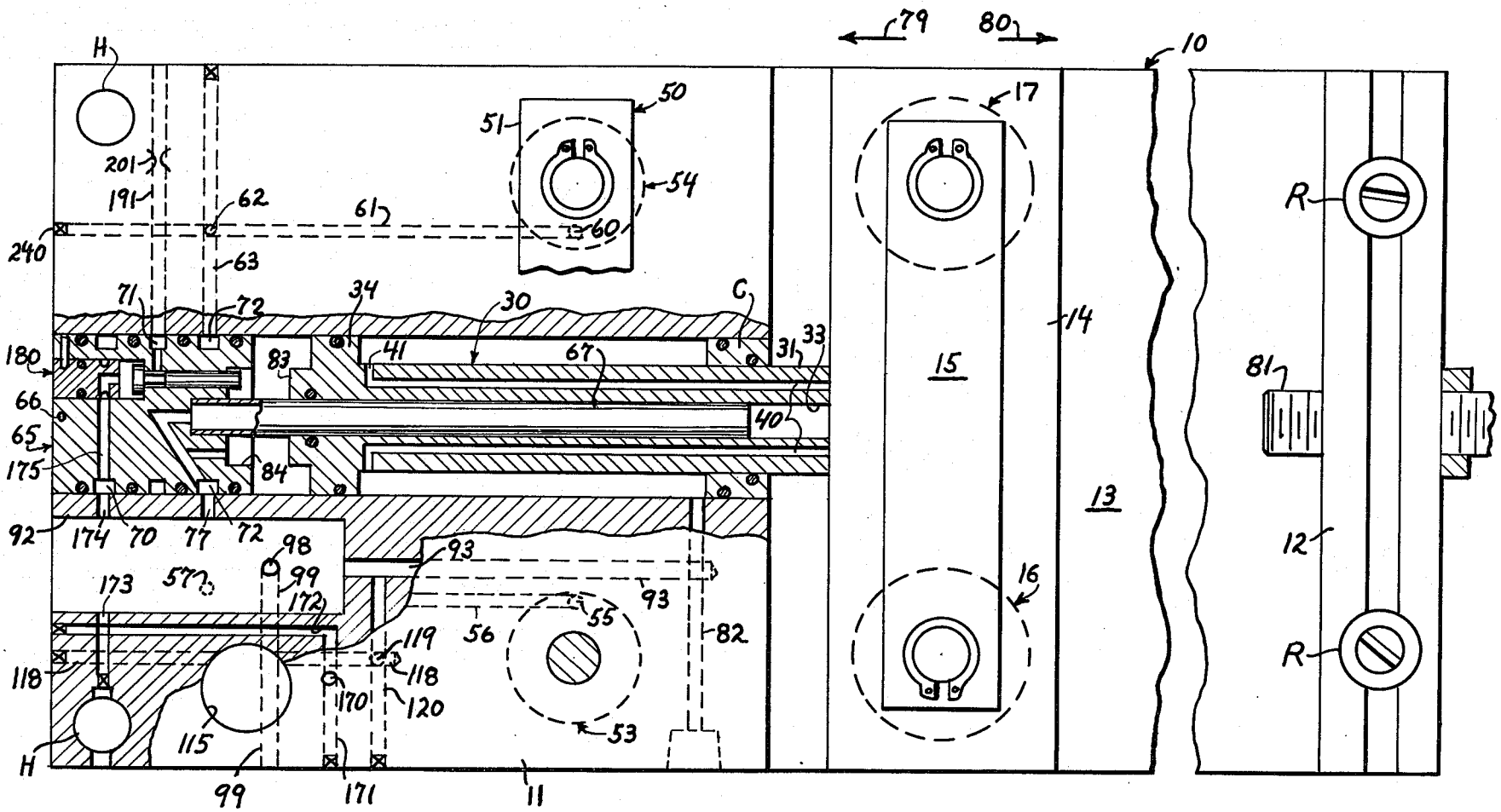
FIG. 1 is a plan view in partial section and illustrates the construction of many of the principal portions of the present feeder including part of its control system.

Referring particularly to FIGS. 1–4 there is shown an integral one-piece U-shaped feeder frame 10 comprising a main block 11, an end block 12, and a flat plate like intermediate portion 13. A pair of mounting holes H, FIG. 1, are formed in the main block 11 to facilitate the mounting of the feeder either on the die set or on the press with which the feeder is to be used. A feed slide 14 is mounted for reciprocating movement on said plate like frame portion 13, and carries a stock gripping means that includes a stock gripping bar 15 which is adapted to be operated by a pair of double acting fluid motors 16 and 17, FIG. 3, in a manner understood in the art. The upper or rod ends of the cylinders of said double acting fluid motors are adapted to be serviced through air lines 20 and 21, FIG. 3, respectively, formed in said feed slide 14, while the lower or head ends thereof are adapted to be serviced by air lines 22 and 23, FIG. 3, also formed in said feed slide. The feed slide 14 is restrained for rectilinear movement by means of a central depending shoulder 24, FIGS. 2 and 3, that is operatively disposed in an elongated central longitudinal T-slot 25, FIGS. 2 and 3, formed in said plate like frame portion 13; said shoulder being slidably secured in said slot by means of a plate 26 that is fastened by any suitable means, such as screws 27, to the bottom of said shoulder as is illustrated in FIGS. 2 and 3. The feed slide 14 is adapted to be reciprocated by means of a main double acting fluid motor 30, FIG. 1, carried by the main block 11; the outer end of the tubular piston rod 31 of said motor 30 extending through a conventional type stationary collar C, FIG. 1, that effectively pneumatically closes the rod end of the main cylinder and being connected to the feed slide 14 by means of a locking screw 32, FIG. 2. The screw 32 has an inner reduced threaded end that threadedly engages the correspondingly internally threaded end of the said piston rod. The central axial passage 33 formed through the piston 34 and the integral piston rod 31 of the main fluid motor 30 communicates with the said air line 23, which services the lower or head ends of said gripper motors 16 and 17, through an axial passage 35, FIGS. 2 and 3, and a communicating diametral passage 36, FIG. 2, both formed in the inner end of said locking screw 32, and through the annular space 37 adjacent the shoulder of screw 32, which annular space communicates with the upper end of said service air line 23. The piston rod 31 is also formed with a plurality of longitudinal air bias passages or lines 40, FIGS. 1 and 2, for servicing the upper or rod ends of said gripper motors 16 and 17 on the feed slide 14. Here the inner end of each such air bias line communicates through an associated passage 41, FIG. 1, in the piston rod wall with the rod end of the cylinder of said main fluid motor 30, while the outer end of each thereof communicates with an internal annular groove 42 formed in the feed slide 14 through an associated diametral passage 43, FIG. 2, formed in the piston rod wall. As indicated in FIG. 3 the internal groove 42 communicates with the inner ends of both of said service air lines 20 and 21 for the rod ends of said gripper motors 16 and 17. To insure the mutual isolation of the two service line systems for the opposite ends of the respective cylinders for said double acting gripper motors 16 and 17 a sealing pad 46, FIG. 3, is provided. Suitable O-ring seals 47 and 48, FIG. 2, are also provided so as to prevent pressure fluid from leaking between the piston rod 31 and the slide 14, and between the feed slide and locking nut 32 respectively.

The main block 11 of the feeder frame carries a stock clamping means 50, FIGS. 1 and 4, comprising a clamp bar 51 which is adapted to be yieldably biased to an upper or stock release position by means of suitable springs 52, FIG. 4, and which is adapted to be displaced to a stock clamping position by means of two single acting fluid motors 53 and 54 in a manner well understood in the art. The fluid motor 43 is adapted to be serviced through the communicating air lines 55, 56 and 57, FIGS. 1, 2, 4, and 7, formed in the main block 11; while the fluid motor 54 is adapted to be serviced by the communicating air lines 60, 61, 62 and 63, FIGS. 1, 2, 4 and 15, also formed in said main block 11.

A plug means 65, FIG. 1, is provided for closing the head end of the cylinder of the main fluid motor 30 and is held in place in the main block 11 by any suitable means such as a dimetral pin 66, FIG. 1. Coaxially secured to plug means 65 is a tube 67 that extends into axial internal telescopic engagement with the said piston 34 and the piston rod 31. The plug means 65, which will now be described in connection with the slightly enlarged FIG. 9, is formed with three axially spaced peripheral grooves 70, 71 and 72 that are mutually isolated from each other and from the main cylinder and the surrounding atmosphere by means of four axially spaced O-rings such as is illustrated at 73 of FIG. 9. The annular groove 72 communicates with an air line 74 formed in the plug means 65 which in turn communicates with the head end of the cylinder of the main fluid motor 30 through a line 75 and with the inside of said axial tube 67 through a line 76. Said groove 72 also communicates with the said line 63, FIGS. 1, 4 and 9, which services the said fluid clamping motor 54 as above described, and also with a line 77, FIGS. 8 and 9, formed in said main block 11 which, as will be explained below, is in communication with the said line 57 that services the other fluid clamping motor 53. Thus when fluid pressure is supplied to the annular groove 72, (a) the stock clamp fluid motors 53 and 54 will be energized so that clamp bar 51 will clamp the stock to be fed, (b) the lower or head ends of the gripper motors 16 and 17 on the feed slide will be energized so as to move said stock gripping bar 15 to an upper or stock release position, and (c) the main fluid motor 30 will have pressure fluid supplied to its head end and will thus move the feed slide 14 in an index or non feed direction 80, FIG. 1, and into engagement with the usual adjustable feed stroke abutment screw 81.

The cylinder of said main double acting fluid motor 30 is adapted to have its rod end continuously supplied with pressure fluid through an inlet supply line 82, FIGS. 1 and 2, formed in the said main block 11; and in that the rod end of this fluid motor 30 is in communication with the rod ends of the gripper fluid motors 16 and 17 through said air line passages 40, 41, 43, FIG. 1, formed in the main piston rod 31 and said passages 42, 20 and 21, FIG. 3, formed in said feed slide as above described, the rod ends of the gripper motors 16 and 17 will also be continuously supplied with pressure fluid. When fluid pressure is exhausted from the groove 72 of the plug means 65, (a) the clamp motors 53 and 54 will be exhausted so as to thereby release the clamp bar 51 for spring actuated movement to an upper or stock release position, (b) the head or lower ends of the gripper motors will be exhausted which will cause the continuously supplied pressure fluid at the upper or rod ends of said gripper motors 16 and 17 to move the stock gripping bar 15 to a stock gripping position, and (c) the head end of the main fluid motor 30 will be exhausted so that the continuously supplied pressure fluid at the rod end thereof will cause said main fluid motor 30 to move said feed slide 14 in a feed direction 79, FIG. 1, and into engagement with the adjacent end of the main block 11. The terminal portion of this stock feed movement of the slide 14 is cushioned by means of an annular projection 83, FIG. 1, cooperating with a correspondingly dimensioned recess 84 formed in the adjacent radial or end face of said plug means 65. In summary then when pressure fluid is supplied to said annular groove 72 the feeder will partake of an index or non-feed stroke and when pressure fluid is exhausted from said groove 72 the feeder will partake of a feed stroke.

Figure 12:
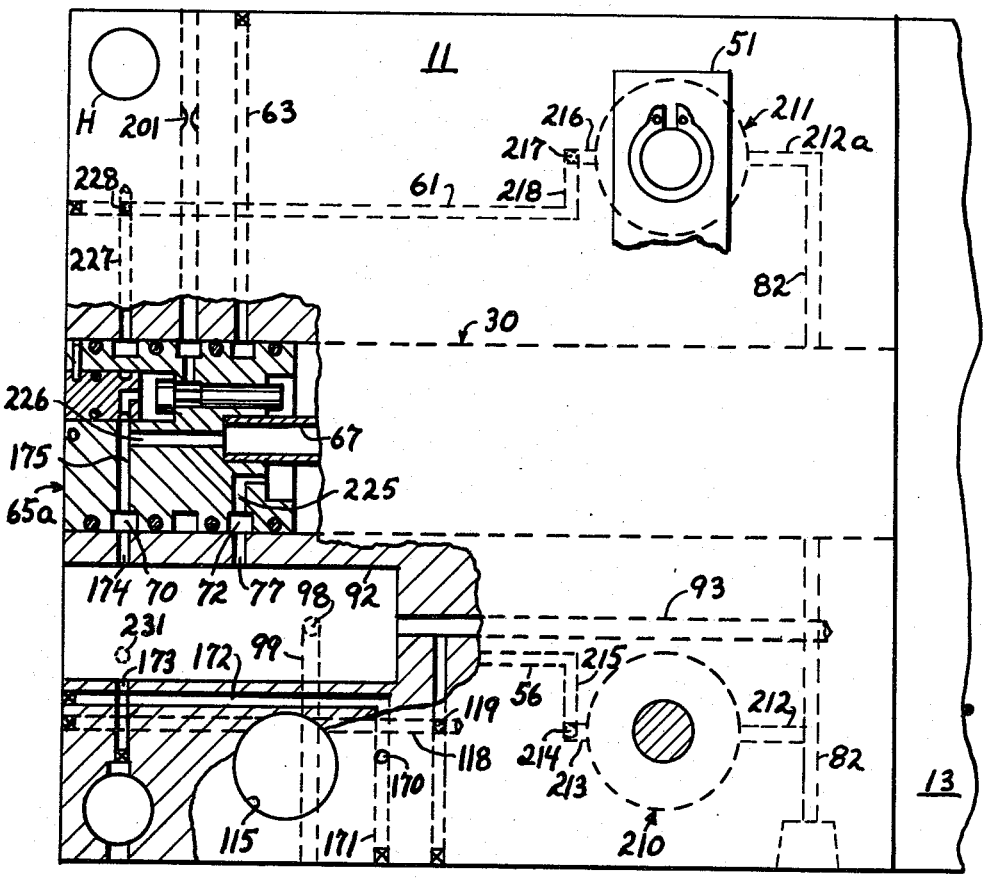
FIG. 12 is a plan view in partial section illustrating the construction and arrangement for a modified version of the present feeder.

The control of the supply and exhaust of pressure fluid to and from said annular groove 72 in the plug means 65 will now be described with initial reference to FIGS. 1, 7 and 8. The groove 72 communicates with said air line 77 formed in said main block 11 and said line 77 communicates with an annular output groove 89, FIG. 8, formed on the cylinder outer tubular wall of a main three way fluid control poppet valve assembly 91, FIG. 8. The control poppet valve assembly 91 which is adapted to be inserted as a unit into a cylindrical recess 92, FIGS. 1 and 8, formed in the main block 11 is preferably constructed and arranged in the same manner as the commercially available main three way control valve assembly that is used to control the main double acting fluid motor of the pneumatic feeders now being marketed by the Rapid Air Corporation of Madison, South Dakota; such feeders being illustrated in U.S. Pat. No. 3,038,645. In FIGS. 1 and 12 the main block 11 is shown with the poppet valve assembly 91 removed from the said recess 92 formed in said main block 11. For convenience in understanding the general construction and operation of this valve assembly 91 a general description thereof will be made with reference to FIG. 8. An inlet air supply line 93 axially communicates with one end of a cylindrical valve chamber 94, and a cylindrical valving element 95 disposed in said chamber 94 is adapted to be axially moved into and out of air flow blocking engagement with the right hand end, as seen in FIG. 8 of said chamber 94 so as to respectively prevent and allow flow of pressure fluid from said supply line 93 into said chamber 94. A valve exhaust line 96 formed through the tubular valve wall communicates with an annular peripheral groove 97, FIG. 8, formed on the cylindrical outside surface of the poppet valve assembly 91, and an exhaust line 98, FIG. 8, formed in the main block 11 has its inner end communicating with said valve exhaust groove 97 while the other end thereof communicates with an exhaust line 99, FIGS. 1, 2 and 7, also formed in said main block. The outer end of exhaust line 99 is open to the surrounding atmosphere. For convenience of illustration the exhaust line 98 is shown in FIG. 8 to be in the plane of FIG. 8, however it is actually disposed normal thereto as is shown in FIGS. 1, 2 and 7. A radially disposed output or control line 90 which communicates with said peripheral groove 89 which is formed in the outer cylindrical surface of the valve assembly 91 so that when the valve element 95 is in its left hand position as shown in FIG. 8 fluid pressure will be permitted to flow from supply line 93 to the valve output or control line 90 and groove 89, and thus to said groove 72, exhaust line 96 then being blocked by the valving element 95, whereby an index stroke of said feed slide is produced as above described. When the valve element 95 is in its right hand position, as viewed in FIG. 8, abutting the right hand end of the valve chamber 94 pressure fluid will be prevented from flowing into chamber 94 from supply line 93 and fluid pressure will be permitted to exhaust from said groove 72 through line 77, the valve groove 89 and valve output line 90, the valve chamber 94, the now uncovered valve exhaust line 96 to the exhaust groove 97 and finally out through the said exhaust lines 98 and 99 so as to produce a feed stroke of said feed slide 14. It should be noted here that the inner end of the service line 57, FIGS. 1, 2 and 7, for the clamp motor 52 communicates with the said output groove 89 of said poppet valve assembly 91 as indicated in FIG. 7, so that said clamp motors 53 and 54 will operate in unison. The location, as would be seen in a plan view, of said vertical line 57 is indicated by a dotted line circle 57 in FIG. 1.

A valve operating fluid motor 100, FIG. 8, is provided in the valve assembly 91 and is adapted when energized to displace the valve element 95 from its said left to its said right hand position; the continuously supplied fluid in the valve supply line 93 serving to move the valve element back to its said left hand position when said fluid motor 100 is deenergized. The fluid motor 100 comprises a piston 101 having a piston rod 102 which is integrally connected thereto and which extends into the chamber 94 and is adapted to contact the adjacent end of said valve element 95. The rod end of the cylinder of said fluid motor 100 is vented by a line 103 formed through the tubular wall of the valve assembly 91 while the head end of the cylinder is provided with an air service line 104 also formed through the wall of the valve assembly 91. The motor vent line 103 communicates through an open line **103*a* to the surrounding atmosphere; the lines 103 and 103*a* for convenience of illustration being shown in the plan view of FIG. 8 as being in the plane of FIG. 8 whereas they actually extend vertically upward as indicated in FIG. 4. The head end of the cylinder of the fluid motor 100, which is effectively closed by a plug 105 that is secured in place in the main block 11 by any suitable means such as a retainer ring 106, also communicates with a release control line 107, FIG. 8, formed through the tubular wall of said valve assembly 91. As will be apparent when the fluid motor 100 is energized by pressure fluid flowing from line 104 into the said head end of the cylinder thereof the piston 101 will shift the valve element 95 to its said right hand position so as to produce a feed stroke of the feed slide 14 and when pressure fluid is released or exhausted from the said head end of fluid motor 100 through release line 107 the valve element 95 will be shifted as above described back to its said left hand or normal position so as to produce an index stroke of said feed slide 14**.

The supply of pressure fluid to the fluid motor 100 is controlled by the combination of a normally conducting three way trigger valve 10, FIGS. 6 and 10, and a cooperating self cut off valve 111, while the exhaust of pressure fluid from said motor 100 is controlled by a reversing or pressure fluid release valve 180, FIGS. 9 and 10. The details of the trigger valve 110 and the self cut off valve 111 will be described first with primary reference to FIGS. 1, 2, 5 and 6, and the release valve 112 will thereafter be described with primary reference to FIGS. 1 and 9.

Referring to FIGS. 1, 2, 5 and 6 the three way trigger valve 110 comprises a cylindrical chamber or recess 115 that is formed in the main block 11; the top of the recess being covered by a valve block 116 that is secured on the top of the main block 11 by any suitable means such as screws 117. In FIG. 1, the valve block 116 has been removed. The lower portion of the valve recess 115 is adapted to be continuously supplied with pressure fluid through an air line 118, FIGS. 1 and 2, formed in the main block 11; said line 118 communicating with said recess 115 and also with a vertical line 119 which in turn communicates with a transverse horizontal line 120 which in turn communicates with said horizontal pressure fluid line 93, FIGS. 1 and 2, that communicates with said main pressure fluid input supply line 82. A shouldered passage 124 which is formed vertically through the said block 116 is coaxially disposed with respect to the said recess 115. Disposed in said passage 124 is a valve disc or poppet 125 which is provided with a peripheral O-ring 126 that is adapted to sealingly and slidably engage the vertical walls of said valve recess 115. The reduced upper end of poppet 125 is adapted to be yieldably biased into normal engagement with the adjacent shoulder 127 of said recess 124 by reason of the continuous pressure fluid in the lower portion of recess 115 continuously acting upwardly on the poppet 125. The lower end of a valve stem or feeder control plunger 130 extends through a shouldered hole axially formed through the poppet 125; the shoulder 131, FIG. 6, on said stem or plunger being normally spaced from the internal shoulder 132 formed in the said poppet axial recess as shown in FIG. 6 but being adapted upon downward movement of stem 130 to sealingly engage the said shoulder 132. The upper limit of movement of stem 130 relative to the poppet 125 is determined by engagement of a diametral pin 133, FIG. 6, carried by the lower reduced end 134 of said stem 130 with the lower radial face 135 of said poppet 125. The cylindrical outer surfaces of the said reduced end 134 of the stem 130 are radially spaced from the adjacent inner walls 136 of the axial hole through said poppet 125. The stem 130 is normally maintained in its upper position relative to poppet 125 by the said continuous action of the pressure fluid in the lower portion of said valve chamber or recess 115. A plurality of radially extending holes 140 formed through the walls of the poppet 125 communicate the central axial hole in the poppet 125 with the annular space surrounding the upper reduced end of the poppet and adjacent the cylindrical wall 141 of the lower portion of the recess 124 in the valve block 116. Communicating through said wall 141 with said annular space is a trigger valve output line 142 that is horizontally formed in the valve block 116.

In the operation of the trigger valve 110 continuous pressure fluid in the lower portion of recess 115 will yieldably maintain said poppet 125 and stem 130 in their said normal or upper positions illustrated in FIG. 6 wherein pressure fluid can flow through the annular space between the reduced lower end 134 of the valve stem 130 and the adjacent internal walls 136 of the poppet 125, and through said radial lines 140 and the annular space adjacent said wall 141 to the said valve output line 142. When the stem 130 is depressed downwardly the stem will initially move axially relative to poppet 125 until the plunger shoulder 131 sealingly engages the internal poppet shoulder 132 so as to prevent further flow of pressure fluid from the lower portion of valve chamber 115 to the valve output line 142. Continued downward movement of the stem 130 will cause the poppet 125 to also move axially downward so that the upper reduced end of the poppet will move away from the shoulder 127 of the valve block 116 whereby pressure fluid in the output line 142 of the trigger valve 110 may now exhaust through an exhaust line or hole 143, FIGS. 5 and 6, which is formed through the wall of said valve block 116 and which communicates with the reduced portion 144, FIG. 2, of the said recess or hole 124 formed through said valve block, said exhaust hole or line 143 being located above said shoulder 127 as is best seen in FIGS. 2 and 5. When the valve stem is permitted to move upwardly the pressure fluid in said lower portion of the valve recess 115 causes both the poppet and the stem to move upwardly until the reduced upper end of the poppet engages the said shoulder 127 thereby blocking further fluid exhaust flow through exhaust hole 143. Continued upward movement of the stem 130 to its normal upper FIG. 6 position causes the stem shoulder 131 to move upwardly out of sealing engagement with the poppet shoulder 132 so that pressure fluid from the lower portion of the valve chamber 115 may again flow into the valve output line 142 as above described.

The output line 142 of the trigger valve is connected to operate the cut off valve 111. Referring now primarily to FIG. 2 the valve block 116 is formed with a right angled passage 150 that comunicates the said output line 142 of the trigger valve with the axial center of the left hand end, as seen in FIG. 2, of a cylindrical valve chamber 151 in which is disposed a valve member 152 that is adapted to be moved into and out of engagement with the said left hand end of the valve chamber 151 so as to respectively prevent and permit flow of pressure fluid from trigger valve output line 142 and line 150 into the chamber 151. Communicating with the said left end of said chamber 151 is a vertically disposed cut off valve output line 153, FIG. 2 and 5, that is formed in the valve block 116. The valve member 152 is adapted to be moved from its right hand, as seen in FIG. 2, flow permitting position to its left hand fluid flow preventing or blocking position shown in FIG. 2 by means of a single acting fluid motor 154, FIG. 2, which comprises a cylinder 155 formed in said valve block 116 and in which is slidably disposed a piston 156 having an integral piston rod that axially extends to the left, as seen in FIG. 2, and is integrally and coaxially connected to the said valve cut off valve member 152. The head end, or right hand end as seen in FIG. 2, of the cylinder 155 is effectively closed by a suitable plug 157 that is secured in said valve block 116 by any suitable means such as a pin 160. Suitable O-ring seals are provided where needed as shown in FIG. 2; and a venting passage 161 is formed through the upper wall of said valve block 116 so as to be capable of venting the rod end of said fluid motor 154 so that said piston 156 may freely move when energized. The valve member 152 and hence the piston 156 of the fluid motor 154 are normally yieldably biased to the right as seen in FIG. 2 by means of a compression spring 162, FIG. 2, disposed in chamber 151 so as to place said valve member in its normal fluid flow permitting position. Pressure fluid is introduced into the right hand end of the cylinder 155 through a line 163, FIG. 2, that communicates between the cylinder 155 and the said trigger valve output line 142. When pressure fluid flows into cylinder 155 the piston 156 will move to the left as seen in FIG. 2 and will thus place said valve member 152 in its said flow blocking position wherein no pressure fluid may flow from line 150 into the valve chamber 151 and to the said valve output line 153.

In the operation of the self cut off valve 111 when the valve member 152 is in its said normal right hand position and pressure fluid is directed into the line 142 by the trigger valve 110 such fluid will flow through line 150 and into the valve chamber 151 from where it will flow into the cut off valve output line 153. Simultaneously, however, the fluid pressure in said trigger valve output line 142 will flow through line 163 and into the cylinder 155 so as to energize said fluid motor 154 whereby said valve member 152 will immediately be moved to its said left hand position wherein pressure fluid flow from the line 150 into chamber 151 and into output line 153 is cut off or blocked. When the output line 142 is exhausted by the above described operation of the trigger valve 110 the spring 162 will cause the valve member 152 and hence the piston 156 to be moved back to its said normal right hand or fluid flow permitting position. A suitable restriction 164, FIG. 10, may be provided in the said line 163 to the fluid motor 154 so that a described short time delay may be obtained between the time that pressure fluid starts flowing from line 150 into chamber 151 and the time that such flow is thereafter cut off by the valve member 152 due to the operation of the fluid motor 154.

The output line 153 from the self cut off valve 111 communicates and is coextensive with a vertical line 170, FIGS. 1 and 2, formed in the main block 11. The line 170 communicates with a transversely disposed horizontal line 171 which in turn communicates with a longitudinally disposed horizontal line 172 which in turn communicates with a transversely disposed horizontal line 173; these lines also being formed in said main block 11. The inner end of line 173 communicates with the said control line 104, as shown in FIG. 8, for the fluid valve motor 100 that operates the said main three way valve 91; (note the circuit diagram of FIG. 10). A line 174, FIGS. 1 and 8, formed in the main block 11 communicates at one end thereof with the said line 107 of the fluid motor 100 and at the other end thereof with the groove 70, FIGS. 1 and 9, formed in the said plug means 65. A line 175 formed in said plug means communicates at one end thereof with said groove 70 and at the other end with said reversing or release valve 180, FIGS. 1, 9 and 10. The release valve 180 will be described with primary reference to FIG. 9 wherein the plug means 65 is shown having a cylindrical valve chamber or recess 181 formed therein; the left end thereof as seen in FIG. 9 having a plug 182 secured therein by any suitable means, such as a pin 183, while in the opposite or right end thereof there is disposed a disc valve member or poppet 184 that is adapted to sealingly seat on the radial end face 185 of said valve recess 181. A reduced size cylindrical hole or passage 186 is also formed in the plug 65 and is coaxially disposed with respect to the said valve recess 181. The poppet 184 has an integral coaxial stem 187 formed thereon which extends through said hole 186 and a short distance into the said recess 84 formed in the inner radial face of said plug means 65; the inner end of stem 187 being adapted to be engaged and displaced by the said piston projection 83 during the terminal portion of a feed stroke of said feed slide 14. The valve stem 187 is formed with a reduced portion adjacent the poppet 184, and a line 190 formed in said plug means 65 communicates at its inner end with said cylindrical hole 186 in the region of said reduced portion of the valve stem 187 and its outer end with the groove 71 peripherally formed in said plug means 65. The inner end of air exhaust or vent line 191, FIGS. 1 and 9, formed in the main block 11 communicates with said groove 71 while the other open end thereof communicates with the surrounding atmosphere. The plug 182 is formed with a peripheral groove 192, FIG. 9, which communicates with the adjacent end of said line 175. The plug 182 is also formed with a right angled line 193 that communicates at one end thereof with said groove 182 and at its other end with the cylindrical valve chamber 181. As will be apparent when pressure fluid flows through lines 175 and 193 into the valve chamber 181 the poppet 184 will be sealingly seated against said radial end surface 185 so as to block the flow of such pressure fluid into the said exhaust or valve release vent lines 190, 191. When however the valve stem 187 is displaced to left, as seen in FIG. 9, by the said main piston projection 83, FIG. 1, during the terminal portion of a feed stroke of the feed slide 14 said poppet 184 will move away from said valving surface 185 so that pressure fluid in said fluid motor 100 and in said lines 107, 174, 175, 192 etc. will be exhausted through said vent release lines 190 and 191.

The cooperation between the above described feeder structure and the various control valves etc. will be best described with reference to the circuit diagram of FIG. 10. The valve stem or feed control plunger 130 is adapted to be engaged, depressed and allowed to return to its normal upper position in response to the vertical reciprocation of the usual control member 200, FIG. 10, secured to the reciprocating working ram of the press with which the present feeder is to be used. As above described when fluid motor 100, FIG. 10, is energized, i.e. pressure fluid is supplied thereto, the main three way valve 91 will be shifted to an operative position wherein the feed slide partakes of a feed stroke, and when the fluid motor 100 is exhausted or deenergized the valve 91 will be shifted to an operative position wherein said feed slide partakes of an index or non-feeding stroke. The normal condition of the control circuit for the main valve element 95 will be such that with the control plunger 130 in its upper normal position the trigger valve 100 will supply pressure fluid to the self cut off valve 111 so that pressure fluid may momentarily flow to and change or fill the fluid motor 100 and the pressure release valve 180 before the fluid motor 154 of the self cut off valve operates to block further flow of fluid pressure through said valve 111. Under these conditions the fluid motor 100 being thus energized will shift the main valve so as to produce a feed stroke of said feed slide 14. During the terminal portion of said feed stroke the projection 83 of the main piston 34, FIG. 1, will engage and displace the valve stem 187 of the reversing or pressure release valve 180 whereby the fluid motor 100 wil be exhausted so that the main valve element 95 may then be restored to its said left hand operative position wherein said feed slide 14 will then automatically partake of an index stroke. A suitable restriction 201, FIG. 1, may be provided in the release valve exhaust line 191 so as to insure a sufficient time delay is present for completion of the said feed stroke by the feed slide 14 before initiation of the said index stroke thereof. Even though the pressure release valve 180 operates to deenergize the valve motor 100 the self cut off valve 111 will remain in its fluid flow blocking condition because the trigger valve 110 continues in its normal condition to supply pressure fluid to said self cut off valve 111 and hence the release valve 180 and the main valve motor 100 are effectively pneumatically isolated from said trigger valve 110 by said self cut off valve 111. Under these conditions then the feed slide after completing its said index stroke will remain in a normal indexed position, i.e. held against the end of the abutment screw 81, until the next feed index cycle of operation of the feeder is initiated. This initiation will be produced by the press ram member 200 engaging, depressing and returning the plunger 130 to its said normal position. Here when the plunger moves down the valve output line 142 will be exhausted so that said spring 162, FIG. 10, can now restore the self cut off valve to its said fluid conducting condition. At this time the other lines from the cut off valve 111 to the release valve 180 and to the main valve motor 100 will already have been exhausted as just described. Thus during this downward movement of the trigger valve control plunger 130 the feed slide will remain in its said normal indexed position. When the press ram moves upwardly biased control plunger 130 will follow such movement so as to automatically return to its said normal upper position. As said plunger reaches its said normal upper position the trigger valve 110 will now direct pressure fluid through its output line 142 to the self cut off valve 111 so that the latter may momentarily conduct pressure fluid to both said main valve fluid motor 100 and the release valve 180 whereupon feed slide 14 initiates the next feed and index strokes as above described so as to thereby advance or feed the strip stock by a predetermined increment into the work station of the press and then return to and remain in its indexed position until the next feed index cycle is initiated. Each such feed index cycle is initiated only after said plunger 130 is first depressed and then returned to its said normal upper position; each feed index cycle being initiated in response to the return movement of said control plunger 130 to its said normal position.

The plug means 65 shown in FIG. 11 may if desired be constructed so that there are two passages 202 and 203 operatively communicating between the head end of the cylinder of the main fluid motor 30 and the line 74 in said plug means; there being a conventional type check valve 204 operatively disposed in said line 202 while the line 203 is of a reduced cross sectional size. This arrangement will permit a relatively rapid exhaust of the head end of the main cylinder through both lines 202 and 203 and a relatively slow supply of pressure fluid through only the small size line 203 to said head end of the main cylinder; this affording a means to control and optimize the desired load versus speed requirements of the respective feed and index strokes of the feed slide.

Figure 13:
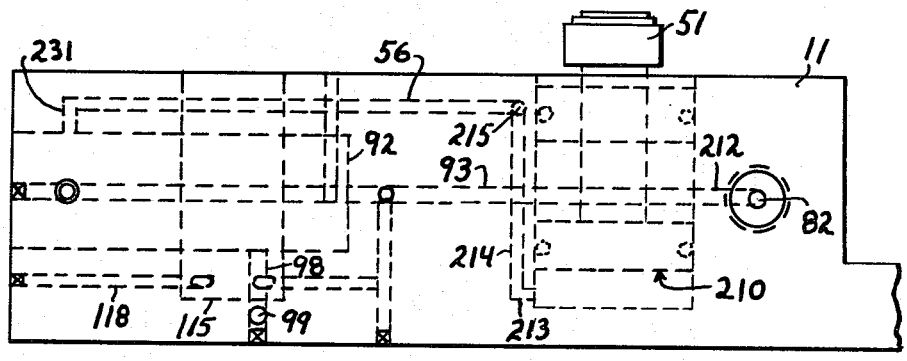
FIG. 13 is a front elevational view of the apparatus of FIG. 12.
Figure 14:
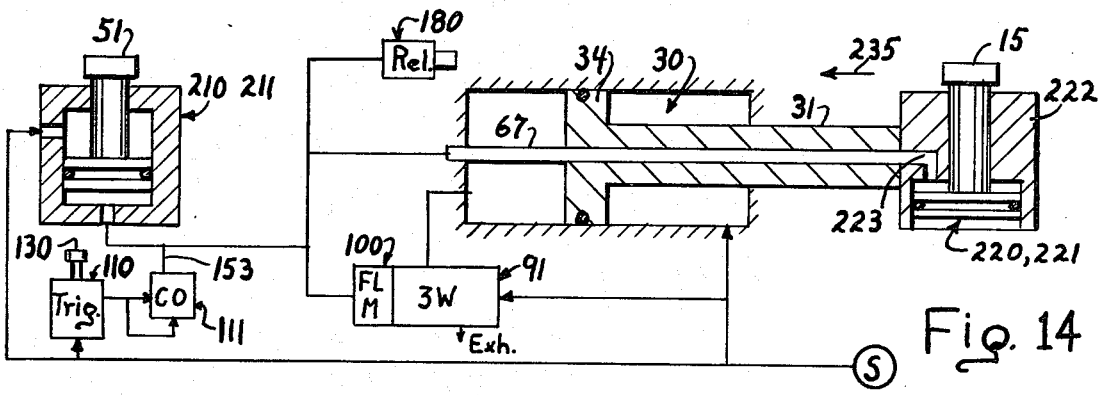
FIG. 14 is a circuit diagram illustrating the semi-automatic control system for the feeder illustrated in FIGS. 12 and 13.

In FIGS. 12–14 a modified version of the control arrangement is shown. Here instead of utilizing double acting gripper motors on the feed slide 14 and single acting stock clamping motors on the main block 11, the stock clamp motors are made double acting and the gripper motors on the feed slide are made single acting. This latter arrangement is used where it is desired to have only one effective fluid conducting line extending from the main block 11 out to the movable feed slide 14; U.S. Pat. No. 3,038,645 illustrating such a structural arrangement which is incorporated herein by reference. In the apparatus of FIGS. 12–14 the various parts, unless otherwise indicated, are similar in construction and operation to the corresponding numbered parts described in connection with FIGS. 1–11 and 15. The rod ends of the double acting clamp motors 210 and 211, FIGS. 12 and 13, are connected to the said supply 82 through lines 212 and **212*a* respectively while the lower or head ends of said double acting motors 210 and 211 are connected to said service lines 56 and 61 respectively by two series of lines 213, 214, 215 and 216, 217, 218 respectively. The two single acting gripper fluid motors 220, 221 carried by the feed slide 222, as illustrated in FIG. 14, are serviced through the said tube 67 and a suitable line 223, FIG. 14, formed in the feed slide 222 in a manner well understood in the art, for example that illustrated in said U.S. Pat. No. 3,038,645. The main control valve assembly 91 including the fluid motor 100, the release valve 180, the self cut off valve 111 and the trigger valve 110 shown in FIG. 14 are all constructed and operate in the same fashion as above described but are interconnected in a different manner. As shown in the circuit diagram of FIG. 10 the output line 77 of the main valve 91 controls not only the main fluid motor 30, but also the stock clamping motors 53 and 54 and the gripper motors 16 and 17. In the FIG. 14 circuit diagram however the main valve assembly 91 controls only the main fluid motor 30 while the gripper motors 220, 221 and the clamp motors 210, 211 are controlled by the output line of the self cut off valve 111. To accommodate this control arrangement a modified plug means 65*a*, FIG. 12, is provided and is formed with a right angled passage 225 interconnecting the groove 72 and the head end of the cylinder of the main fluid motor 30 so that only the main fluid motor 30 is controlled by the said output line 77, FIG. 12, from said main poppet valve assembly 91. The plug means 65*a* is formed with another passage 226 which interconnects the gripper supply tube 67 with the said line 175 which line in turn is connected through the peripheral groove 70 to a line 227; the latter being connected through a vertical passage 228, FIG. 12, to the said service line 61 for said clamp motor 211. The corresponding service line 56, FIGS. 12 and 13, to said clamp motor 210 is also effectively connected to the said groove 70 through the line 174, FIG. 12, the cylinder of fluid motor 100 and a vertical line 231, FIG. 13, formed in the main block 11; the plan view location of where the line 231 would be being indicated by a dotted circle 231 in FIG. 12**.

As a result of the structural arrangement described in connection with FIGS. 12 and 13 it will be seen from the circuit diagram of FIG. 14 that the self cut off valve 111 is operative to momentarily conduct pressure fluid from the trigger valve 110 to not only the fluid motor 100 and the release valve 180 as before but also now to said gripper motors 220, 221 and to the clamp motors 212 and 213 whereby the feed slide 222, FIG. 14, will partake of a feed stroke in the feed direction 235, FIG. 14; and that when the release valve 180 is operated by the main piston extension 83 to exhaust the associated lines 175, 193 etc. the fluid motor 100 for the main valve will be deenergized and the clamp and gripper motors will be operated whereby an index stroke of said feed slide 222 will be produced. This semi-automatic operation is thus equivalent of that described above for the apparatus of FIGS. 1–11 and 15.

Suitable static and/or sliding seals, such as O-rings, are provided where needed and the outer ends of the various drilled air conducting lines may be plugged where desired or needed as is indicated for example at 240 of FIG. 1 for the outer end of the said line 61. Also conventional type transversely adjustable stock guide rollers R, FIG. 1, are provided on the end block 12 of the main frame 10 for guiding the strip stock into the feeder.

With the above described feeder arrangement and related control circuits the present semi-automatic feeder may be readily interfaced with the punch press and only one control point in each cycle of operation of the press ram need be used to control the feeder; this point corresponding to the arrival of the control plunger 130 back to its said normal position. Setting up the feeder on the press is quick and easy and there is no elaborate or expensive interfacing equipment required between the main crank shaft of the punch press and the feeder control plunger 130 or other portions of the present control system. Further the semi-automatic control for the present feeder will add little if any cost over that for conventional non semi-automatic feeders of the type shown in said U.S. Pat. Nos. 3,038,645 and 3,329,327.

I claim:

1. A pneumatic feeder for intermittently advancing strip stock into the work station of a punch press that has a reciprocating working ram; said feeder comprising a frame;

feed slide means mounted on said frame for reciprocating movement in feed and index directions;

stock gripping means carried by said feed slide means;

a first fluid motor means for actuating said feed slide means;

a second fluid motor means for actuating said stock gripping means;

a main fluid valve means adapted to be shifted between first and second operative conditions;

a third fluid motor means for shifting said main valve means between said first and second operative condition;

a control plunger means adapted to move between first and depressed positions in response to the movement of said press ram;

pneumatic control means adapted to cause said feed slide means to be normally disposed in an indexed position and to cause initiation of a feed stroke of said feed slide means in response to movement of said plunger means from its said depressed position back to its said first position in response to the upward movement of said press ram; and reversing means adapted to be operated in response to the terminal portion of a feed stroke of said feed slide means for causing said first, second and third fluid motor means to initiate an index stroke of said feed slide means whereby said feed slide means returns to and remains in its said indexed position until said plunger means is again moved from its said first to its said depressed position and then returned to its said first position in response to the downward and upward movements respectively of said ram, the next feed index cycle of movement of said feed slide means being initiated in response to this return movement of said control plunger means from its said depressed position back to its said first position.

2. Apparatus as defined by claim 1 wherein said pneumatic control means includes a trigger valve means that is adapted to be operated by said plunger means, and a self cut off valve means that is adapted to momentarily conduct pressure fluid therethrough, and wherein said reversing means includes a release valve which when operated serves to cause said main valve means to shift to its said first operative condition.

3. Apparatus as defined by claim 2 wherein said trigger valve means is disposed in a fluid conducting condition when said control plunger means is in its said first position.

4. Apparatus as defined by claim 2 wherein said release valve is coupled to the output of said cut off valve means and to the control lines to said second and third fluid motor means.

5. Apparatus as defined by claim 2 wherein said self cut off valve means includes a cut off valve that is adapted when operated to interrupt the flow of pressure fluid from the output of said trigger valve means to said third fluid motor means, and a fourth fluid motor means which is adapted to operate said cut off valve and which communicates with, and is adapted to be energized by pressure fluid from, the output from said trigger valve means.

6. Apparatus as defined by claim 5 wherein said release valve when operated is adapted to deenergize said third fluid motor means while said trigger valve means maintains said fourth fluid motor means energized whereby said cut off valve maintains said trigger valve means effectively pneumatically isolated from said release valve and said third fluid motor means.

7. Apparatus as defined by claim 5 wherein said cut off valve is normally biased to its pressure fluid conducting position and is adapted to be shifted to its pressure fluid cut off position when said fourth fluid motor means is energized by said trigger valve means.

8. Apparatus as defined by claim 1 wherein the output of said main valve means controls the operation of both said first and second fluid motor means.

9. Apparatus as defined by claim 1 wherein the output of said main valve means controls the operation of said first fluid motor means but not that of said second fluid motor means.

10. Apparatus as defined by claim 1 wherein said main valve means includes a three way valve that is adapted when said third fluid motor means is deenergized to assume its first pressure fluid conducting condition.

11. Apparatus as defined by claim 1 wherein said reversing means is adapted to be operated by the piston of said first fluid motor means.

12. Apparatus as defined by claim 1 wherein said pneumatic control means includes a valve means for generating a momentary flow of pressure fluid to said third fluid motor means and said reversing means and for thereafter blocking such flow and permitting the exhaust of said pressure fluid from said third fluid motor means under the control of said reversing means.

13. In a pneumatic feeder for intermittently advancing strip stock into the work station of a punch press having a reciprocating working ram; said feeder including a frame;

feed slide means mounted on said frame for reciprocating movement in feed and index directions;

stock gripping means carried by said feed slide means;

a first fluid motor means for actuating said feed slide means;

a second fluid motor means for actuating said stock gripping means;

a main fluid valve means adapted to be shifted between first and second operative conditions;

a third fluid motor means for shifting said main valve means; and a control plunger means movable between first and second positions in response to the movement of said press ram: the improvement comprising a semi-automatic control system adapted to cause said feed slide means to be normally disposed in an indexed position and to initiate a feed stroke thereof after said control plunger means is moved from its said first to its said second position and then back to its said first position in response to the downward and upward movements respectively of said press ram, said control system including a trigger valve means adapted to be operated in response to the operation of said control plunger means;

said control system also including a self cut off valve means operatively connected to said trigger valve means and adapted to momentarily transmit pressure fluid therethrough so as to thereby cause initiation of a feed stroke of said feed slide means, said self cut off valve means after momentarily conducting pressure fluid therethrough then being operative to effectively block flow therethrough of pressure fluid; and reversing mans adapted to be operated in response to the terminal portion of a feed stroke of said feed slide means for causing said first, second and third fluid motor means to initiate an index stroke of said feed slide means whereby said feed slide means returns to and remains in its said indexed position until said plunger means is again moved from its said first to its said second position and then returned back to its said first position in response to the downward and upward movements respectively of said ram, the return movement of said control plunger means back to its said first position serving to cause initiation of a start signal for the next cycle of movement of said feed slide means.

14. A pneumatic feeder for intermittently advancing stock into the work station of a punch press having a reciprocating working ram: comprising a frame;

a feed slide reciprocally mounted on said frame and adapted to be alternatively displaced in feed and index directions;

a first fluid motor means for actuating said feed slide;

stock gripping means carried by said feed slide and adapted to be moved between stock gripping and release positions;

a second fluid motor means for actuating said stock gripping means;

a main fluid valve means for controlling said first and second fluid motor means and adapted to be shifted between first and second operative conditions;

a third fluid motor means for shifting said main valve means between said operative conditions;

a control plunger means movable between first and depressed positions in response to the movement of said press ram;

a semi-automatic control system adapted to cause said feed slide means to be normally disposed in an indexed position and to initiate a feed stroke thereof after said plunger means is moved first to its said depressed position and then back to its said first position in response to the downward and upward movements respectively of said press ram, said control system including a trigger valve means adapted to be operated in response to the operation of said control plunger means;

said control system also including a self cut off valve means operatively connected to said trigger valve means and adapted to momentarily transmit pressure fluid therethrough to said third fluid motor means so as to shift said main valve means to its second operatve position and thereby initiate a feed stroke of said feed slide means, said self cut off valve means after momentarily conducting said pressure fluid then being operative to effectively block flow therethrough of pressure fluid; and release means for said main valve means operable in response to the terminal portion of a feed stroke of said feed slide for causing said main valve means to be shifted to its said first operative condition wherein said first and second fluid motor means cause said feed slide to partake of an index stroke so as to move to and remain in a normal indexed position until after said plunger means is again depressed and returned back to its said first position in response to the next downward and upward movement respectively of said press ram.

15. A pneumatic feeder for intermittently advancing stock into the work station of a punch press having a reciprocating working ram: comprising a frame;

a feed slide reciprocally mounted on said frame and adapted to be alternately displaced in feed and index directions;

a first fluid motor means for actuating said feed slide;

stock gripping means carried by said feed slide and adapted to be moved between stock gripping and release positions;

a second fluid motor means for actuating said stock gripping means;

a main fluid valve means adapted to be shifted between first and second operative conditions;

a third fluid motor means for shifting said main valve means between said operative conditions;

a control plunger means movable between first and depressed positions in response to the movement of said press ram;

a semi-automatic control system adapted to cause said feed slide means to be normally disposed in an indexed position and to initiate a feed stroke thereof after said plunger means is depressed and then moved back to its said first position in response to the downward and upward movements respectively of said press ram, said control system including a trigger valve means adapted to be operated by said plunger means and being capable of operating said second and third fluid motor means whereby said main valve means may be shifted from its first to its second operative condition and said first and second fluid motor means may be operated to cause said feed slide to partake of a feed stroke;

said control system also including a self cut off valve means operatively associated with said trigger valve means and said second and third fluid motor means, said self cut off valve means when actuated serving to interrupt the flow of pressure fluid to said second and third fluid motor means and to effectively pneumatically isolate said second and third fluid motor means, and reversing means operable in response to the terminal portion of a feed stroke of said feed slide for controlling said second and third fluid motor means while said self cut off valve means is in its pressure fluid cut off condition so that said main valve means may be shifted from its said second to its said first operative condition and said first and second fluid motor means may be operated to cause said feed slide to partake of an index stroke and move to its said normal indexed position and remain there until said plunger means is again depressed and returned to its said first position in response to the downward and upward movements respectively of said ram so as to thereby initiate the next feed index cycle of movement of said feed slide, the initiating of said next feed index cycle of movement being responsive to the movement of said plunger means from a depressed position back to its said first position.

16. A pneumatically operated feeder for intermittently advancing stock into the work station of a punch press or the like: said feeder comprising a frame;

a feed slide reciprocally mounted on said frame and adapted to be actuated in feed and index directions;

stock gripping means carried by said feed slide and adapted to be moved between stock gripping and stock releasing positions;

a first double acting fluid motor for reciprocally actuating said feed slide, said first fluid motor including a piston and a piston rod;

means defining a pressure fluid supply line that is connected to the rod end of said first double acting fluid motor whereby pressure fluid may be continuously supplied to said rod end of said first fluid motor so that said feed slide may be continuously biased in said feed direction;

a second double acting fluid motor carried by said feed slide and adapted to actuate said stock gripping means;

means defining a first fluid conducting passage in said piston rod, the inner end of said first passage communicating through the walls of said piston rod with the said rod end of said first fluid motor while the outer end thereof communicates through a fluid conducting line formed in said feed slide with the rod end of said second double acting fluid motor carried by said feed slide whereby said stock gripping means may be continously biased to said stock gripping position while said feed slide is simultaneously continuously biased in said feed direction;

means defining a second separate fluid conducting passage in said piston rod and in said piston of said first double acting fluid motor, the outer end of said second fluid conducting passage communicating through another fluid conducting line formed in said feed slide with the head end of said second double acting fluid motor;

a fluid conducting tube carried at one end thereof by said frame and disposed adjacent the head end of said first fluid motor and extending so that it's other end telescopically engages the adjacent inner end of said second fluid conducting passage formed in said piston and piston rod of said first fluid motor; and control valve means communicating with said one end of said tube and with the said head end of said first double acting fluid motor and adapted to exhaust pressure fluid simultaneously from the head ends of said first and second fluid motors so that said continuous biasing actions at the rod ends of said first and second fluid motors produce a stock feed stroke of said feed slide, and to supply pressure fluid simultaneously to said head ends of said first and second fluid motors so as to thereby produce an index stroke of said feed slide against said continuous biasing actions of said first and second fluid motors.

* * * * *